US006305171B1

(12) United States Patent
Negre et al.

(10) Patent No.: US 6,305,171 B1
(45) Date of Patent: Oct. 23, 2001

(54) METHOD AND DEVICE FOR ADDITIONAL THERMAL HEATING FOR MOTOR VEHICLE EQUIPPED WITH POLLUTION-FREE ENGINE WITH ADDITIONAL COMPRESSED AIR INJECTION

(76) Inventors: Guy Negre, Zone Industrielle 3405 4e avenue BP 547; Cyril Negre, Zone Industrielle 3405-4e av. - BP 547, both of Carros Cedex (FR), F-06516

( * ) Notice: Subject to any disclaimer, the term of this patent is extended or adjusted under 35 U.S.C. 154(b) by 0 days.

(21) Appl. No.: 09/582,220

(22) PCT Filed: Jan. 22, 1999

(86) PCT No.: PCT/FR99/00126

§ 371 Date: Jul. 20, 2000

§ 102(e) Date: Jul. 20, 2000

(87) PCT Pub. No.: WO99/37885

PCT Pub. Date: Jul. 29, 1999

(30) Foreign Application Priority Data

Jan. 22, 1998 (FR) ..... 98 00877

(51) Int. Cl.[7] ..... F01K 7/34

(52) U.S. Cl. ..... 60/653; 60/668; 60/39.6

(58) Field of Search ..... 60/645, 653, 654, 60/668, 39.6

(56) References Cited

U.S. PATENT DOCUMENTS

| | | | | |
|---|---|---|---|---|
| 3,148,508 | * | 9/1964 | Karig | 60/668 X |
| 3,986,575 | * | 10/1976 | Eggmann | 60/616 X |
| 4,086,773 | * | 5/1978 | Kanegae et al. | 60/668 X |
| 4,294,323 | * | 10/1981 | Boese | 60/668 X |
| 4,444,024 | * | 4/1984 | McFee | 62/401 |
| 4,696,158 | * | 9/1987 | DeFrancisco | 60/39.02 |

FOREIGN PATENT DOCUMENTS

| | | | |
|---|---|---|---|
| 2074195 | * | 10/1971 | (FR) . |
| 2668199 | * | 4/1992 | (FR) . |
| 2689568 | * | 10/1993 | (FR) . |

* cited by examiner

*Primary Examiner*—Hoang Nguyen
(74) *Attorney, Agent, or Firm*—Jacobson Holman, PLLC

(57) ABSTRACT

The invention concerns a method for additional thermal heating for motor vehicle equipped with pollution-free engine operating with additional compressed air injection into the combustion chamber (2) and having high pressure compressed air storage reservoir (23). The high pressure compressed air contained in the reservoir is previously to its final use at a lower pressure, directed towards a thermal heater (56) to increase its pressure and/or volume before it is injected into the combustion or expension chamber (2). The invention is applicable to all engines equipped with compressed air injection.

11 Claims, 4 Drawing Sheets

Figure 1:
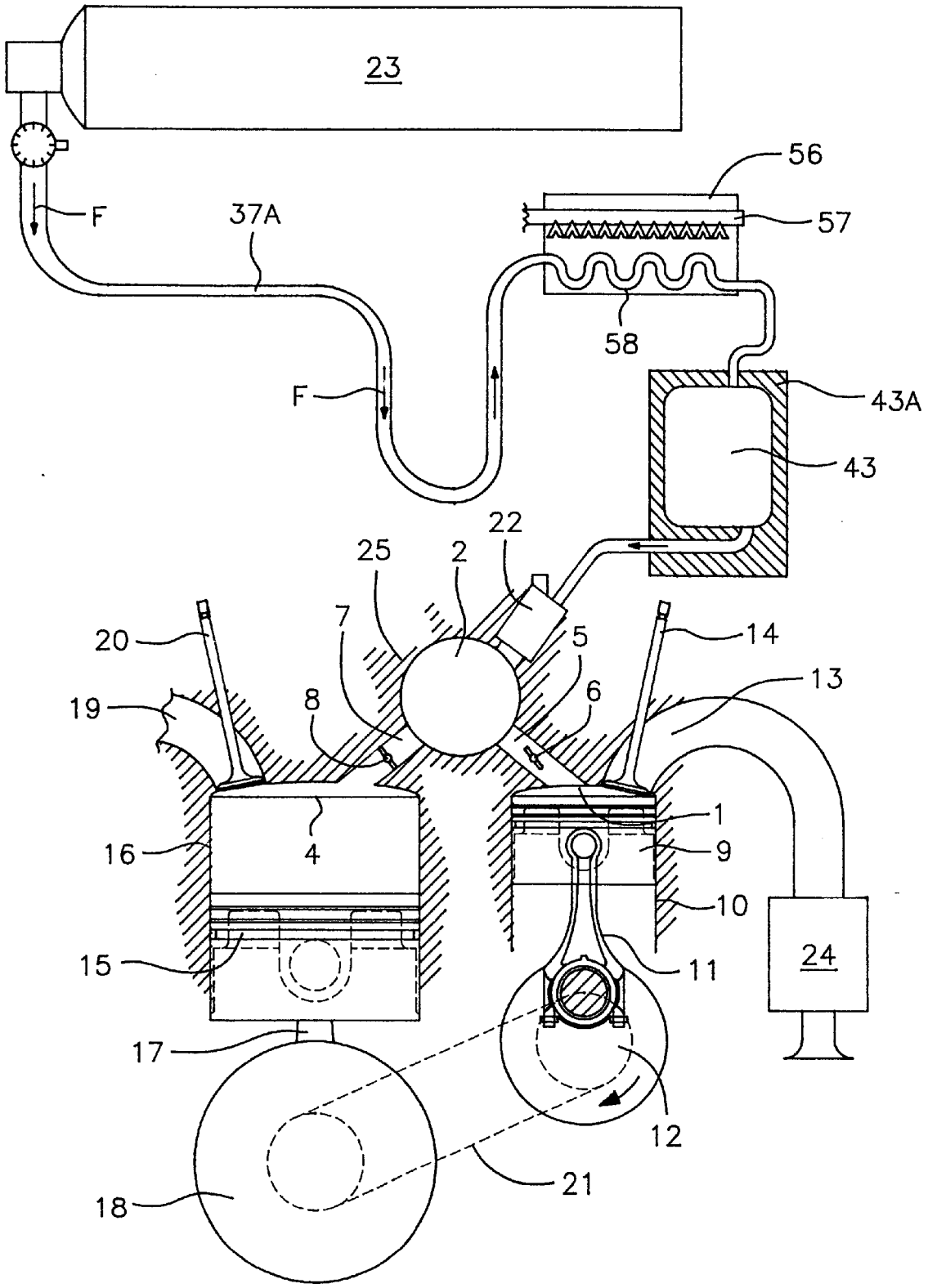

METHOD AND DEVICE FOR ADDITIONAL THERMAL HEATING FOR MOTOR VEHICLE EQUIPPED WITH POLLUTION-FREE ENGINE WITH ADDITIONAL COMPRESSED AIR INJECTION

The invention relates to land vehicles and more particularly to those equipped with engines that are free of pollution or that reduce pollution with independent or otherwise combustion chambers operating with the injection of additional compressed air and comprising a high-pressure compressed-air reservoir.

In his published patent application WO 96/27737, the author has described a depolluting method for an engine with an independent external combustion chamber, operating on a two-mode principle using two types of energy, using either conventional fuel such as gasoline or diesel oil on the highway (single-mode air/fuel operation) or, at low speed, particularly in urban and suburban areas, using an addition of compressed air (or any other non-polluting gas) into the combustion chamber to the exclusion of any other fuel (single-mode air operation, that is to say operation with the addition of compressed air). In his patent application FR 96/07714, the author has described the installation of this type of engine in single-mode operation, with the addition of compressed air, on service vehicles, for example town buses.

In this type of engine, in air/fuel mode, the air/fuel mixture is taken into and compressed in an independent intake and compression chamber. This mixture is then transferred, still at pressure, into a constant-volume independent combustion chamber where it is ignited to increase the temperature and pressure of said mixture. Once a transfer port connecting said combustion or expansion chamber with an expansion and exhaust chamber has opened, this mixture will be expanded in the latter chamber where it will produce work. The expanded gases are then discharged to the atmosphere through an exhaust pipe.

When operating on air plus additional compressed air, this being the mode of most interest in the context of the invention, at low power, the fuel injector is no longer operated; in this case, a small amount of additional compressed air from an external reservoir in which the air is stored at high pressure, for example 200 bar, and at ambient temperature is introduced into the combustion chamber appreciably after the (fuel-free) compressed air from the intake and compression chamber has been let into this chamber. This small amount of compressed air at ambient temperature heats up upon contact with the mass of air at high temperature contained in the combustion or expansion chamber, expands and increases the pressure prevailing in the chamber so as to allow motive power to be delivered during expansion.

This type of dual-mode or dual-energy (air and fuel or air and additional compressed air) engine can also be modified for a preferred use in town, for example, on all vehicles and more particularly on town buses or other service vehicles (taxis, garbage trucks, etc.), in air/additional compressed air single-mode operation by dispensing with all the elements whereby the engine operates with the conventional fuel.

The engine operates only in single mode with the injection of additional compressed air into the combustion chamber, which thus becomes an expansion chamber. Furthermore, the air taken in by the engine can be filtered and purified through one or more charcoal filters or using some other mechanical or chemical method or molecular sieve or some other filter so as to produce a pollution-reducing engine. In the current text, the use of the term "air" should be understood as meaning "any non-polluting gas".

In this type of engine, the additional compressed air is injected into the combustion or expansion chamber at a service pressure that is determined according to the pressure prevailing in the chamber and appreciably higher than this pressure, so as to allow its transfer, for example 30 bar. To do this, use is made of a pressure-reducing expander of conventional type, which performs work-free expansion without absorbing heat, and therefore without lowering the temperature, thus allowing expanded air (at about 30 bar in our example) and at ambient temperature to be injected into the combustion or expansion chamber.

This method of injecting additional compressed air can also be used on conventional two- or four-stroke engines in which said injection of additional compressed air into the combustion chamber of the engine is performed approximately at top dead center on an ignition stroke.

The method according to the invention proposes a solution which makes it possible to increase the amount of energy available and which can be used. It is characterized by the means employed and more specifically by the fact that the compressed air, before being introduced into the combustion and/or expansion chamber, is routed through a thermal heater where its pressure and/or volume increases, thus considerably improving the performance that can be achieved by the engine.

In his patent application No. 9700851, the author has also described a method for recovering heat energy from the surroundings for this type of engine in which the compressed air contained in the storage reservoir at very high pressure, for example 200 bar, and at ambient temperature, for example 20°, prior to its end use at a lower pressure of, for example, 30 bar is expanded to a pressure close to the pressure needed for its end use in a variable-volume system, for example in a piston in a cylinder, producing work which can be recovered and used by any known means, mechanical, electrical, hydraulic or the like. This expansion with work has the consequence of cooling the compressed air which has been expanded to a pressure close to the service pressure to a very low temperature, for example −100° C. This compressed air, expanded to its service pressure, and at very low temperature is then sent into an exchanger with the ambient air, is heated up to a temperature close to ambient temperature, and its pressure and/or its volume thus increases, recovering the thermal energy taken from the atmosphere.

Another feature of the method according to the invention proposes a solution which involves the method for recovering heat energy which has just been described hereinabove and which makes it possible to further improve the amount of energy available and that can be used. It is characterized by the means implemented and more particularly by the fact that the compressed air, having passed through the air/air heat exchanger and before being introduced into the combustion chamber, is routed into a thermal heater where it once again increases in pressure and/or in volume before being introduced into the combustion and/or expansion chamber, but considerably improving the performance that can be achieved by the engine.

The use of a thermal heater has the advantage that it is possible to use clean continuous combustion which can be catalyzed or cleaned by any known means, it can be supplied with a conventional fuel such as gasoline, diesel oil, butane gas, propane gas, LPG or the like, just as it may use chemical reactions and/or electrical energy to produce the heating of the compressed air passing through it.

The person skilled in the art will be able to calculate the amount of very-high-pressure air to be supplied to the expansion-with-work system, and the characteristics and volumes of the latter so as, at the end of this expansion with work, and bearing in mind the heating power, to obtain the chosen final service pressure and the temperature which is as cold as possible, and to do so according to the use of the engine. Electronic management of parameters makes it possible at every instant to optimize the amounts of compressed air used, recovered and heated. The person skilled in the art will also be able to determine the engineering details and characteristics of the thermal heater which can employ any concept known in this field without altering the method of the invention.

According to one feature of the invention, the thermal heater used to heat the compressed air from the high-pressure storage reservoir, which may or may not come via the system for recovering heat energy from the ambient surroundings, is also used, independently or in combination with the two solutions described hereinabove, that is to say directly from the storage reservoir or via the heat energy recuperator, to heat up compressed air taken from the engine intake and compression chamber, thus increasing its pressure and/or its volume before re-introducing it into the combustion and/or expansion chamber to allow an increase in the pressure of the gases contained in said combustion chamber prior to expansion in the expansion and exhaust cylinder which produces the power stroke.

The compressed air sent into the thermal heater comes from the storage reservoir, from the device for recovering heat energy from the ambient surroundings, from a tapping from the intake and compression chamber, separately or in combination, in proportions that are determined according to the conditions of use.

Figure 2:
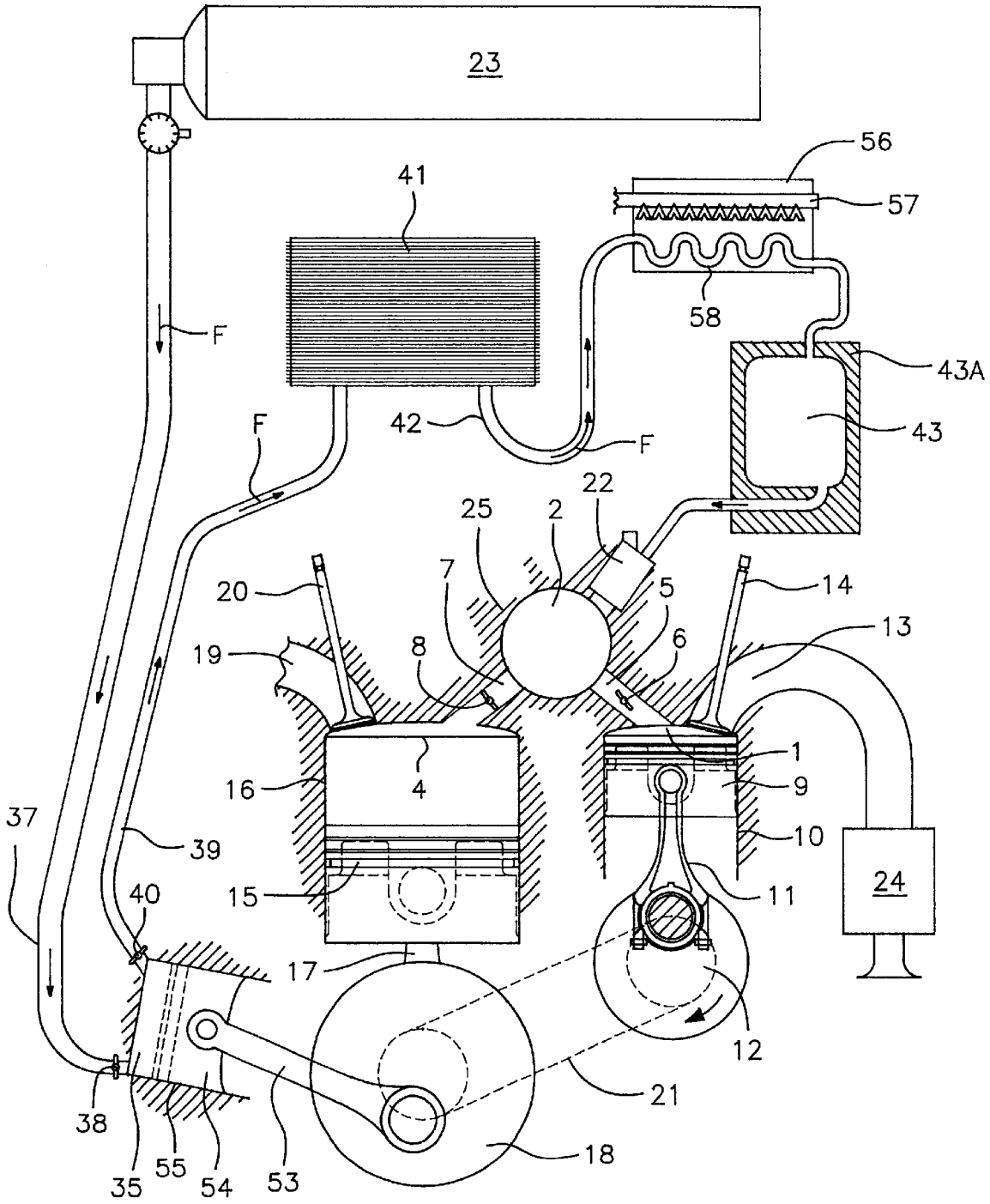
Figure 3:
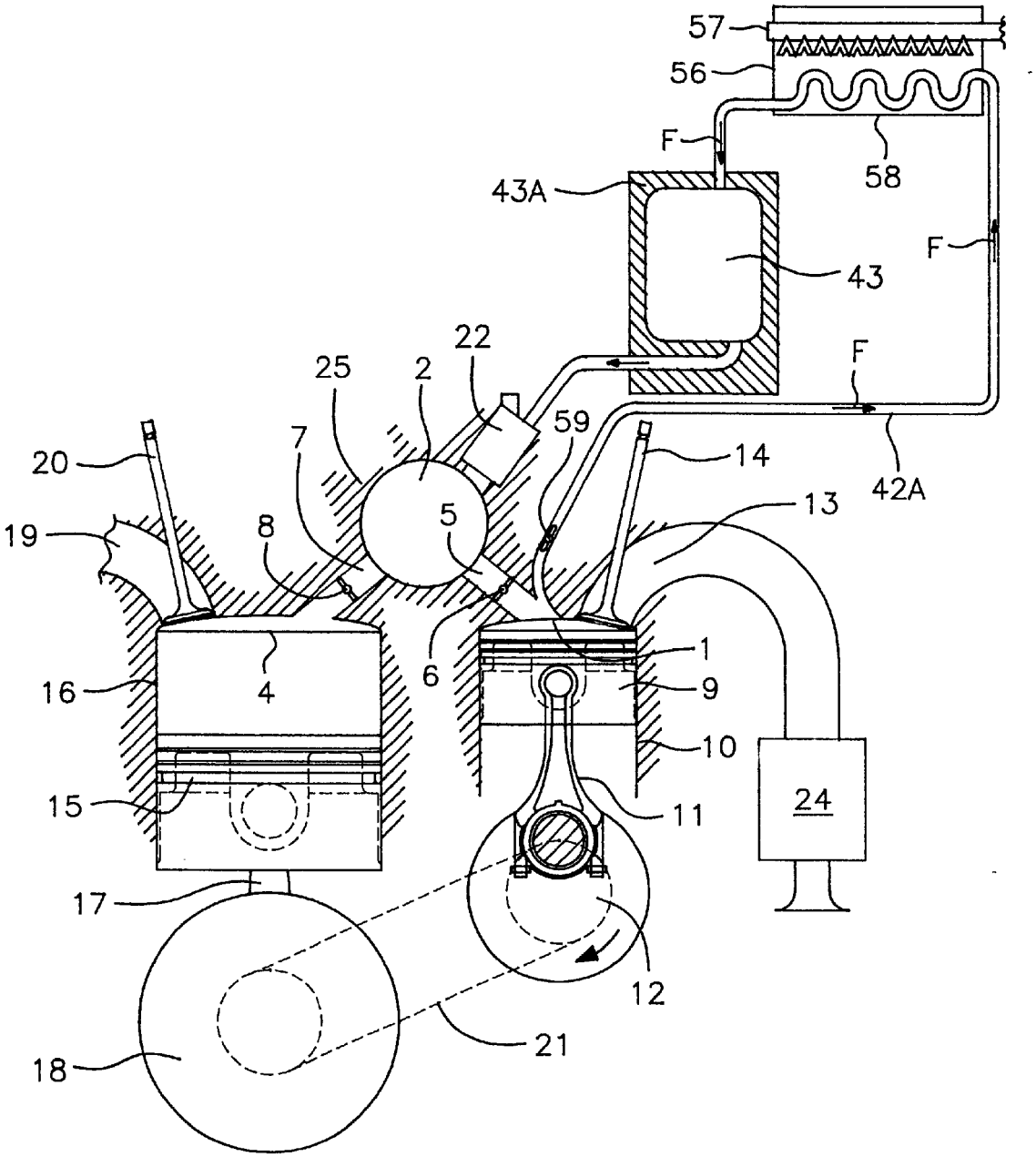
Figure 4:
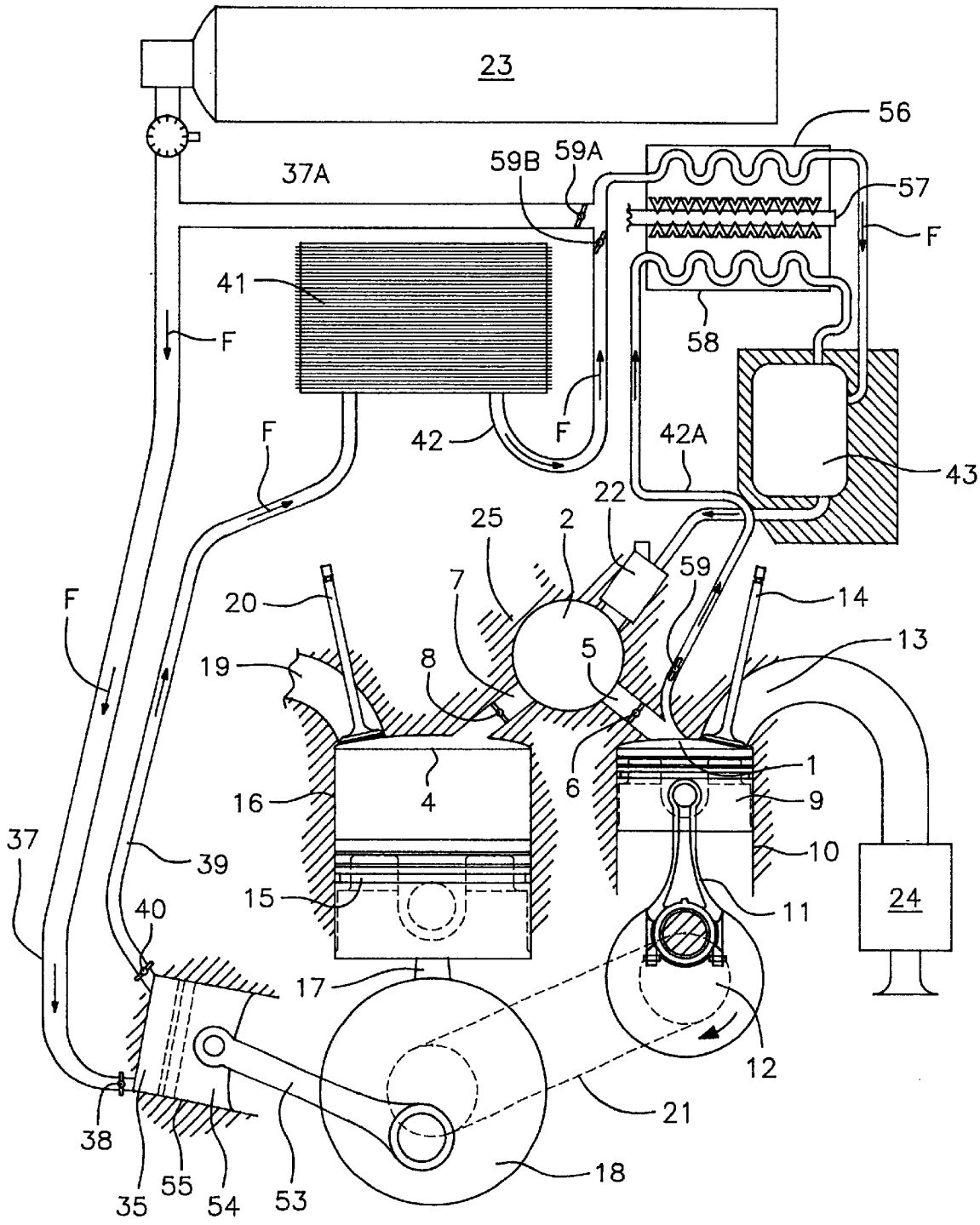

Other objects, advantages and features of the invention will become apparent upon reading the nonlimiting description of a number of particular embodiments which are given with reference to the appended drawings in which:

FIG. 1 is a diagrammatic depiction in cross section of a pollution-free engine equipped with a thermal heater device, FIG. 2 is a depiction, in cross section, of a pollution-free engine with recovery of heat energy from the ambient surroundings, equipped with a thermal heater device, FIG. 3 is a depiction of an engine equipped with a thermal heater device as a bypass on the compressed air through the intake-compression chamber, FIG. 4 is a depiction of an engine combining all three solutions.

FIG. 1 is a diagrammatic depiction in cross section of a pollution-free engine and of its compressed-air supply installation, comprising an intake and compression chamber 1, a constant-volume combustion or expansion chamber 2 in which there is an additional air injector 22 supplied with compressed air stored in a very-high-pressure reservoir 23 and an expansion and exhaust chamber 4. The intake and compression chamber 1 is connected to the combustion or expansion chamber 2 by a pipe 5, the opening and closure of which are controlled by a sealed shutter 6. The combustion or expansion chamber 2 is connected to the expansion and exhaust chamber 4 by a pipe or transfer port 7, the opening and closure of which are controlled by a sealed shutter 8. The intake and compression chamber 1 is supplied with air by an intake pipe 13, the opening of which is controlled by a valve 14 and upstream of which there is a pollution-reducing charcoal filter 24.

The intake and compression chamber 1 operates like a piston compressor assembly in which a piston 9, sliding in a cylinder 10, is controlled by a connecting rod 11 and a crankshaft 12. The expansion and exhaust chamber 4 controls a conventional piston-engine assembly with a piston 15 sliding in a cylinder 16, which, via a connecting rod 17, drives the rotation of a crankshaft 18. The expanded air is exhausted through an exhaust pipe 19, the opening of which is controlled by a valve 20. The rotation of the crankshaft 12 of the intake and compression chamber 1 is controlled through a mechanical link 21 by the drive crankshaft 18 of the expansion and exhaust chamber 4.

According to the invention, fitted on the pipe 37A between the high-pressure storage reservoir 23 and a buffer volume at the almost constant end-usage pressure 43, is a thermal heater 56 consisting of burners 57 which considerably increase the temperature and therefore the pressure and/or the volume of the compressed air from the reservoir 23 (in the direction of the arrows F) as it passes through the exchange coil 58 to allow a considerable improvement in engine performance.

The engine is equipped in FIG. 2 with a device for recovering heat energy from the ambient surroundings, in which the expansion with work of the high-pressure compressed air stored in the reservoir 23 is performed in an assembly comprising connecting rod 53 and working piston 54 coupled directly to the drive shaft 18. This piston 54 slides in a blind cylinder 55 and determines a working chamber 35 into which there open, on the one hand, a high-pressure air intake pipe 37, the opening and closure of which are controlled by an electrically operated valve 38 and, on the other hand, an exhaust pipe 39 connected to the air/air heat exchanger or radiator 41 which is itself connected by a pipe 42 to a buffer volume 43 at the practically constant end-usage pressure. During operation, when the working piston 54 is at its top dead center, the electrically operated valve 38 is opened then closed again so as to let in a charge of very-high-pressure compressed air which will expand, driving back the piston 54 as far as its bottom dead center, and drive the engine crankshaft 18 via the connecting rod 53. During the upstroke of the piston 54, the electrically operated exhaust valve 40 is then opened and compressed but expanded and very-low-temperature air contained in the working chamber is discharged (in the direction of the arrow F) into the air/air heat exchanger or radiator 41. This air will thus be heated up to a temperature close to ambient temperature and will increase in volume as it reaches the buffer volume 43 having recuperated a not insignificant amount of energy from the atmosphere.

According to the invention, fitted between the air/air exchanger 41 and the buffer volume 43 on the pipe 42A is a thermal heater 56 consisting of burners 57 which will considerably increase the temperature and therefore the pressure and/or the volume of the compressed air coming (in the direction of the arrows F) from the air/air exchanger 41 as it passes through the exchange coil 58.

According to one feature of the invention, in FIG. 3, the thermal heater 56 is fitted as a bypass of the intake and compression chamber 1, from which some of the air compressed by the piston 9 is directed (in the direction of the arrows F) toward the thermal heater 56 and as it passes through the exchange coil 58 heated by the burners 57 it will increase in pressure and/or in volume before being introduced into the buffer volume 43 and being injected by the injector 22 into the combustion and/or expansion chamber 2.

FIG. 4 depicts a diagrammatic view of a device combining the three devices described in FIGS. 1 and 2 and 3, the burners 57 of the thermal heater 56 at the same time heating up some of the air compressed by the piston 9 of the intake and compression chamber 1 in an exchange coil 58 before driving it into the buffer volume 43 and the compressed air from the storage reservoir via the device for recovering heat energy from the ambient surroundings and the air/air exchanger 41.

The thermal heater 56 receives compressed air from the storage reservoir 23 along a pipe 37A, from the device 41 for recovering thermal energy from the ambient surroundings along another pipe 42 and from the intake and compression chamber 1 along a third pipe 42A; each of these pipes has a controlled regulating valve 59, 59A, 59B which makes it possible to determine the proportions of compressed air from each source that are to be heated according to the conditions of use.

Systems of regulating valves, for igniting the burners and for regulating the intensity of the burners are installed for heating to a greater or lesser extent the compressed air which passes through the heating coil according to the energy requirements for the driving of the vehicle thus equipped.

The buffer volume 43 placed between the thermal heater 56 and the injector 22 may advantageously be lagged by an insulating jacket 43A, made of materials known for this purpose, to make it possible for the compressed air to retain the heat energy accumulated in the thermal heater 56 before being injected into the chamber. The person skilled in the art will be able to choose the size of the buffer volume 43 and the lagging materials and similarly the pipework and various pipes may also be lagged without this in any way altering the invention which has just been described.

Of course, the invention is not restricted to the embodiments described and depicted and can be varied in numerous ways accessible to those skilled in the art without in any way departing from the spirit of the invention.

What is claimed is:

1. In a thermal heating method for an engine or vehicle equipped with an engine that is free of pollution or that reduces pollution, operating with injection of additional air into a combustion or expansion chamber and which has a high-pressure compressed-air storage reservoir, the improvement which comprises:

expanding compressed air contained in the high-pressure storage reservoir, prior to its final use at a lower pressure and prior to being introduced into a thermal heater to allow at least one of its pressure and its volume to increase before it is injected into the combustion or expansion chamber, to a pressure in a variable-volume system, producing work, the consequence of which is that of cooling the compressed air thus expanded to a low temperature, thereafter sending the thus-cooled air into a heat exchanger to heat it and thus increase at least one of its pressure and its volume by recovering additional heat energy from ambient surroundings.

2. A method according to claim 1 wherein the variable-volume system is a piston in a cylinder.

3. A thermal heating method according to claim 1, wherein the compressed air which is sent into the thermal heater comes from the storage reservoir, from a device for recovering heat energy from ambient surroundings, from a tapping from an intake and compression chamber separately or in combination, in proportions that are determined according to conditions of use.

4. A thermal heating method according to claim 1, wherein the compressed air which is sent into the thermal heater comes from the storage reservoir, from the device for recovering heat energy from ambient surroundings, from a tapping from the intake and compression chamber separately or in combination, in proportions that are determined according to conditions of use.

5. A thermal heater device which comprises a thermal heater (56), a burner (57), a heat-exchange coil (58), a storage reservoir (23), an additional compressed air injector (22), a combustion or expansion chamber (2), and a buffer volume (43), wherein the thermal heater (56), which consists of the burner (57) fed with a fuel and of the heat-exchange coil (58), is positioned between the storage reservoir (23) and the additional compressed air injector (22), the burner (57) being means for heating up the air from the storage reservoir as it passes through the coil (58) so as to increase at least one of its pressure and its volume before it is injected into the combustion or expansion chamber (2), the buffer volume (43) being positioned between the thermal heater and the additional compressed air injector (22) making it possible to even out and avoid surge effects prior to said injection.

6. A thermal heater device according to claim 5 further comprising a pipe (42) and a radiator (41), wherein the thermal heater (56) is positioned on the pipe (42) between the air/air heat exchanger or radiator (41) of the device for recovering heat energy from the ambient surroundings and the buffer volume (43) before it is injected into the combustion of expansion chamber (2).

7. A thermal heater device according to claim 5 further comprising a heat exchanger (56), an intake and compression chamber (1), a pipe (42) and a valve (59), wherein the heat exchanger (56) is positioned between the intake and compression chamber (1) of the engine and the buffer volume (43) on a bypass circuit consisting of the pipe (42) in which flow rate is controlled by the valve (59) which allows compressed air at the end of compression to be tapped off to be directed to the thermal heater so that at least one of its pressure and its volume can be increased before it is injected into the combustion or expansion chamber.

8. A thermal heater device according to claim 5 further comprising one pipe (37A), a device (41) for recovering heat energy from the ambient surroundings, a second pipe (42), an intake and compression chamber (1), a third pipe (42A), and a controlled regulating valve (59, 59A, 59B), wherein the thermal heater (56) receives compressed air from the storage reservoir (23) along the one pipe (37A), from the device (41) for recovering heat energy from the ambient surroundings along the second pipe (42), and from the intake and compression chamber (1) along the third pipe (42A), and wherein each of these pipes comprises the controlled regulating valve (59, 59A, 59B) that makes it possible to determine the proportions of compressed air from each source that is to be heated according to the conditions of use.

9. A thermal heater device according to claim 5, which further comprises a jacket (43A) and wherein the buffer volume placed between the thermal heater (56) and the injector (22) is lagged by the jacket (43A) to allow the heat energy accumulated in the thermal heater to be retained.

10. A thermal heating method for an engine or vehicle equipped with an engine that is free of pollution or that reduces pollution, operating with the injection of additional air into the combustion or expansion chamber, wherein compressed air is taken from the intake and compression chamber at the end of compression to be directed toward a thermal heater so that at least one of its pressure and its volume can be increased before it is injected into the combustion or expansion chamber.

11. A thermal heating method according to claim 10, wherein the compressed air which is sent into the thermal heater comes from the storage reservoir, from the device for recovering heat energy from the ambient surroundings, from a tapping from the intake and compression chamber separately or in combination, in proportions that are determined according to conditions of use.

* * * * *